US005971838A

United States Patent [19]

Watkins

[11] Patent Number: 5,971,838

[45] Date of Patent: Oct. 26, 1999

[54] RAIL-SCRAPER DEVICES AND INSTALLATIONS

[76] Inventor: Terence John Watkins, 9 Hill Farm Road, Chalfont St. Peter, Gerrards Cross, United Kingdom

[21] Appl. No.: 09/018,900

[22] Filed: Feb. 5, 1998

[30] Foreign Application Priority Data

Feb. 6, 1997 [GB] United Kingdom ..... 9702422

[51] Int. Cl.[6] ..... B24B 19/00

[52] U.S. Cl. ..... 451/434; 451/429; 451/415

[58] Field of Search ..... 451/415, 424, 451/429, 434, 350, 347

[56] References Cited

U.S. PATENT DOCUMENTS

| | | | |
|---|---|---|---|
| 3,823,455 | 7/1974 | McIlrath et al. | 451/347 |
| 3,850,691 | 11/1974 | Bleil et al. | 451/347 |
| 3,945,152 | 3/1976 | Helgemeir | 451/347 |
| 4,062,295 | 12/1977 | Hamann . | |
| 4,091,578 | 5/1978 | Panetti | 451/347 |
| 4,178,724 | 12/1979 | Bruno | 451/347 |
| 4,205,494 | 6/1980 | Rivoire | 451/347 |
| 4,206,908 | 6/1980 | Mercier . | |

FOREIGN PATENT DOCUMENTS

| | | |
|---|---|---|
| 2 321 413 | 3/1977 | France . |
| 2 417 026 | 9/1979 | France . |
| 1 270 327 | 4/1972 | United Kingdom . |
| 1 362 269 | 8/1974 | United Kingdom . |
| 2 284 186 | 5/1995 | United Kingdom . |

*Primary Examiner*—David A. Scherbel
*Assistant Examiner*—Derris Holt Banks
*Attorney, Agent, or Firm*—Davis and Bujold

[57] ABSTRACT

An abrasive block 1 used for scraping wet leaves, snow or ice from a rail R of a railway track in order to enhance traction, is urged onto the rail R by a piston 2 under oil-pressure within a cylinder 3. The pressure is created via a diaphragm 11 which separates the oil in the cylinder 3 from an air-chamber 12. Chamber 12 is supplied with air via a regulator 14, from the air-brake supply system 16 of the train, and has a dump valve 19 for dissipating air-pressure surges. A return spring 20 under the piston 2 is active in retracting the block 1 when air-pressure in the chamber 12 is reduced.

10 Claims, 1 Drawing Sheet

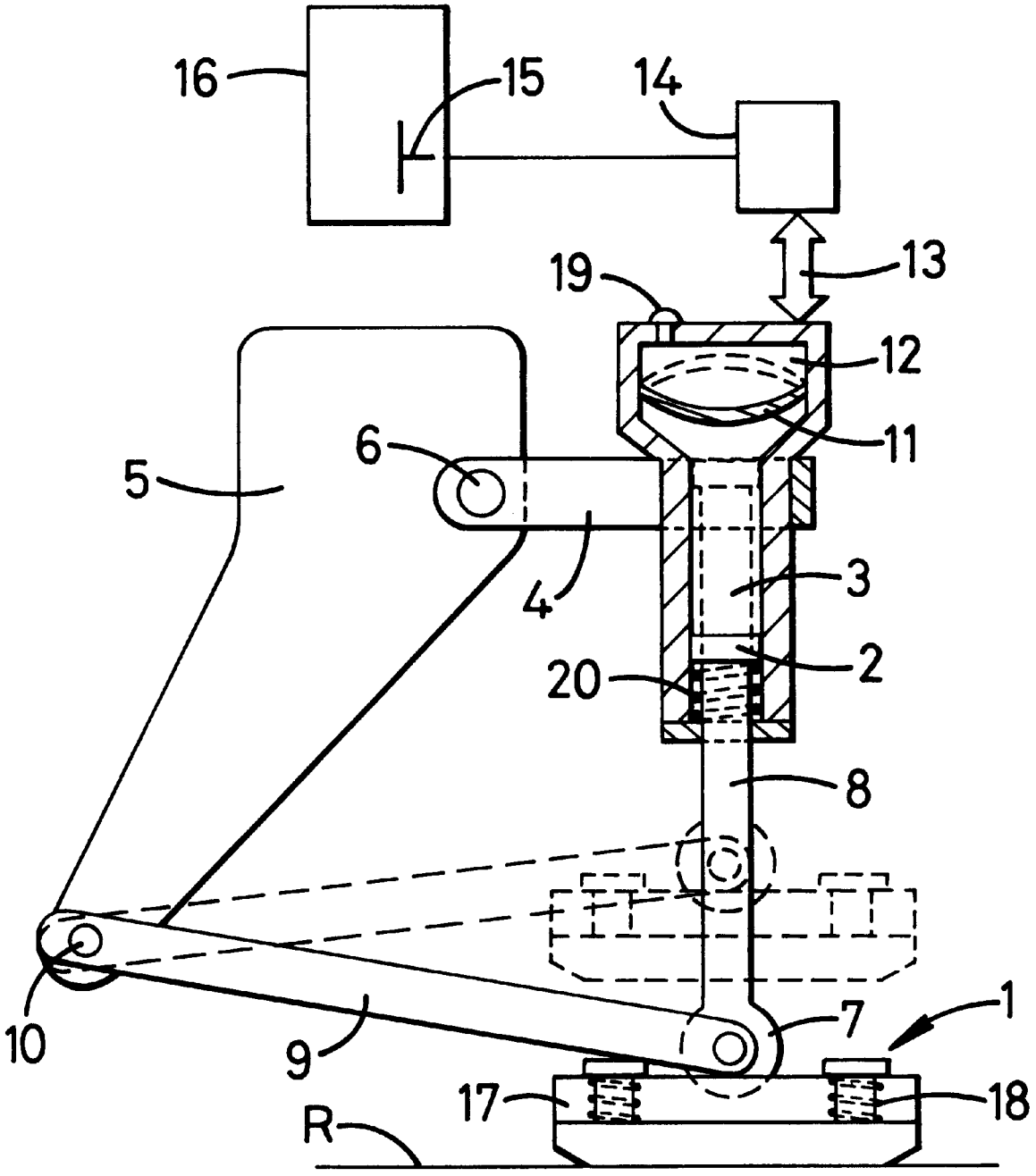
16
15
14
13
19
12
11
6
5
4
3
2
20
8
10
9
7
1
17
18
R

RAIL-SCRAPER DEVICES AND INSTALLATIONS

This invention relates to rail-scraper devices and rail-scraper installations of railway trains, and is concerned especially with such devices and installations capable of clearing wet leaves, snow and ice from the rails of the railway track to enhance traction.

According to one aspect of the present invention there is provided a rail-scraper device for a railway train, wherein a scraper block is coupled to a piston that slides within a cylinder in accordance with oil-pressure within the cylinder, and means for connection to a pressurised-air source is arranged to apply the supplied-air pressure to the oil within the cylinder to exert force on the piston urging the scraper block down onto the rail.

The supplied-air pressure may be applied to the oil via a diaphragm. Furthermore, the device may include a support frame for mounting the cylinder on the train, and a pivoted radius arm extending from the support frame for restraining sideways movement of the block and strengthening purposes.

According to another aspect of the present invention there is provided a rail-scraper installation of a railway train, wherein a scraper block is coupled to a piston that slides within a cylinder in accordance with oil-pressure within the cylinder, and means connected to a pressurised-air source of the train via an air-regulator applies the supplied air-pressure to the oil within the cylinder to exert force on the piston urging the scraper block down onto the rail.

A rail-scraper device and installation thereof on a railway train, in accordance with the present invention will now be described, by way of example, with reference to the accompanying drawing. The drawing shows the installed rail-scraper device in schematic form.

Referring to the drawing, the rail-scraper device involves an abrasive block 1 for scraping wet leaves, snow or ice from a rail R of the railway track. The block 1 is urged downwardly onto the rail R by a piston 2 that slides within a cylinder 3. The cylinder 3 is supported upright on a bracket or arm 4 that is fixed to a support frame 5 via a rubber-bushing mount 6, and the block 1 is secured to the lower end 7 of the piston rod 8 of the piston 2, beneath the cylinder 3.

A radius arm 9 is coupled to the lower end 7 of the rod 8 for restraining the block 1 from side-slap and for strengthening purposes. The arm 9 is pivoted to the frame 5 in a rubber-bushing mount 10, to allow for retraction of the block 1 from its extended, rail-scraping position shown, when not in use. The positions of the block 1 and arm 9 for the retracted position are illustrated in broken line in the drawing.

The support frame 5 carrying the cylinder 4 and scraper block 1 is installed on the train on a cross-member which is mounted in front of the leading wheel-set (not shown) on the axle box. A rail-scraper device of the form illustrated is located in the installation in front of, or just behind, each wheel of the leading wheel-set. Installations of this form are provided at both ends of the train so as to allow for running in both forward and reverse directions. The two devices at whichever end of the train is leading, will each be actuated so as to extend its respective scraper blocks 1 from the retracted position onto the rails, whenever there is traction difficulty because of, for example, wet leaves, snow or ice on the track.

The scraper block 1 is extended from its retracted position and urged down onto the rail R under oil-pressure acting on the piston 2 within the cylinder 3. The oil-pressure is created via a diaphragm 11 that separates the oil above the piston 2 in the cylinder 3, from air within an air-chamber 12. Air supply to the chamber 12 represented by the arrow 13 is derived from the existing air-supply compressor of the train; in particular, the air is supplied to the chamber 12 via a regulator 14, from a T-piece 15 tapped into the air-brake supply system 16 of the train.

The air supplied under pressure to the chamber 12 causes deflection of the diaphragm 11 (from the position shown in broken line in the drawing) to exert pressure on the oil in the cylinder 3. This forces the piston 2 down within the cylinder 3 to close the scraper block 1 onto the rail R. By now maintaining a constant air-pressure in the chamber 12 via the regulator, the scraper block 1 is urged against the rail R with an even pressure for clearing the rail to ensure uncompromised traction.

The block 1, which is readily detachable from the end 7 of the piston rod 8 to enable replacement when necessary, that a backing-plate 17 which incorporates springs 18 that are compressed under the downward force exerted by the piston 2. The resilience provided by the plate 14 and the piston-damper effect of the air-over-oil operation within the cylinder 3, are effective to provide a smooth cushioned action with compensation for pitch and roll of the train in maintaining the block 1 on the rail R. A dump valve 19 is provided in the chamber 12 to dissipate any operating-pressure surges that may occur.

The scraper block 1 is retracted by reducing the air-pressure within the chamber 12 and, therefore, the oil-pressure within the cylinder 3. In this respect, moreover, a spring 20 is fitted within the cylinder 3 to act on the underside of the piston 2 for positive retraction of the block 1. The spring 20 acts as a safety device to retract the block 1 in the event of failure of air-pressure supply or other malfunction.

I claim:

1. A rail-scraper device for mounting on a railway train for scraping a rail of a track on which the train runs, said device comprising a cylinder containing oil, a piston being located within the oil for sliding within the cylinder in response to pressure of the oil within the cylinder, the piston being responsive to the oil-pressure within the cylinder to exert a force dependent on that pressure, a scraper block for contact with the rail, means coupling the piston to the scraper block for urging the scraper block against the rail in accordance with said force exerted by the piston, and means for connection to a pressurized-air source to apply air under pressure from said source to the oil within the cylinder to increase the oil-pressure within the cylinder, the piston responding to the increased oil-pressure to exert increased force on the scraper block urging the scraper block harder down onto the rail for enhancing traction of the train with the rail.

2. A rail scraper device according to claim 1 wherein said means for connecting to a pressurized-air source includes a diaphragm for applying the air pressure to the oil.

3. A rail scraper device according to claim 1 including a support frame for mounting the cylinder on the train, and a pivoted radius arm extending from the support for strengthening purposes, said arm extending from the support frame to the means coupling the piston to the scraper block for restraining movement of the block laterally of the rail.

4. A rail-scraper device according to claim 1 wherein the scraper block has a backing plate, and the backing plate includes springs for compression under the force exerted by the piston urging the block onto the rail.

5. A rail-scraper device according to claim 1 wherein said means for connection to a pressurized-air source includes a dump valve for dissipation of surges in air-pressure applied to the oil.

6. A rail-scraper installation of a railway train for scraping a rail of a railway track on which the train runs, comprising a cylinder containing oil, a piston being immersed in the oil for sliding within the cylinder in response to oil-pressure within the cylinder to exert a force dependent on that pressure, the piston being responsive to increase of the oil-pressure within the cylinder to increase the force exerted by the piston, a scraper block for contact with the rail, means coupling the piston to the scraper block for urging the scraper block against the rail in accordance with the force exerted by the piston, said coupling means coupling the piston to the scraper block to urge the scraper block harder against the rail with an increase of said force, and means connected to a pressurized-air source of the train to apply air under pressure from said source to the oil within the cylinder for exerting force on the piston urging the scraper block down onto the rail to enhance traction of the train with the rail, and said means including an air-pressure regulator for regulating the supplied-air pressure.

7. A rail-scraper installation according to claim 6 wherein said means connected to a pressurized-air source includes a diaphragm, means for applying the air-pressure from the source to the diaphragm, and means mounting the diaphragm for application of pressure in accordance with the air-pressure to the oil in the cylinder.

8. A rail-scraper installation according to claim 6 wherein the pressurised-air source is an air-brake supply system of the train.

9. A rail-scraper installation according to claim 6 including a radius arm pivoted to the support frame, said arm extending from the support frame to the means coupling the piston to the scraper block for restraining movement of the block laterally of the rail.

10. A rail-scraper installation according to claim 6 wherein said means connected to the pressurized-air source includes a dump valve for dissipation of surges in air-pressure applied to the oil.

* * * * *